US011311987B2

(12) United States Patent
Tillinghast et al.

(10) Patent No.: US 11,311,987 B2
(45) Date of Patent: Apr. 26, 2022

(54) METHODS FOR USING FASTENER INSTALLATION TOOLS

(71) Applicant: SIMPSON STRONG-TIE COMPANY INC., Pleasanton, CA (US)

(72) Inventors: Adam Tillinghast, Nashville, TN (US); Troy Hale, Goodlettsville, TN (US)

(73) Assignee: SIMPSON STRONG-TIE COMPANY INC., Pleasanton, CA (US)

( * ) Notice: Subject to any disclaimer, the term of this patent is extended or adjusted under 35 U.S.C. 154(b) by 139 days.

(21) Appl. No.: 16/932,448

(22) Filed: Jul. 17, 2020

(65) Prior Publication Data

US 2020/0346328 A1 Nov. 5, 2020

Related U.S. Application Data

(63) Continuation of application No. 15/991,099, filed on May 29, 2018, now Pat. No. 10,792,794.

(51) Int. Cl.

| | |
|---|---|
| ***B25B 23/08*** | (2006.01) |
| ***B25B 21/00*** | (2006.01) |
| ***B25B 23/00*** | (2006.01) |

(52) U.S. Cl.

CPC ..... *B25B 23/08* (2013.01); *B25B 21/002* (2013.01); *B25B 21/007* (2013.01); *B25B 23/005* (2013.01); *B25B 23/0035* (2013.01)

(58) Field of Classification Search

CPC ... B25B 23/08; B25B 23/005; B25B 23/0035; B25B 21/002; B25B 21/007

See application file for complete search history.

(56) References Cited

U.S. PATENT DOCUMENTS

| | | | |
|---|---|---|---|
| 3,864,839 | A | 2/1975 | Wolf |
| 4,132,496 | A | 1/1979 | Casto |
| 4,785,544 | A | 11/1988 | Heinsius et al. |
| 4,922,621 | A | 5/1990 | Maier |
| 4,945,799 | A | 8/1990 | Knetzer |
| 5,361,504 | A | 11/1994 | Huang |
| 5,740,705 | A | 4/1998 | Graham |
| 5,791,207 | A | 8/1998 | Ahdoot |
| 6,109,145 | A | 8/2000 | Habermehl |
| 6,301,997 | B1 | 10/2001 | Welte |

(Continued)

FOREIGN PATENT DOCUMENTS

| | | |
|---|---|---|
| CN | 202922337 U | 5/2013 |
| EP | 3705232 U | 9/2020 |
| FR | 3029128 A1 | 6/2016 |

OTHER PUBLICATIONS

Armstrong Ceiling Systems, Installation Manual for Lay-in Modular Ceiling (accessed Nov. 6, 2017).

(Continued)

*Primary Examiner* — Nathaniel C Chukwurah

(74) *Attorney, Agent, or Firm* — Buchalter; Cecily Anne O'Regan

(57) ABSTRACT

Methods for using installation tools are disclosed. Fastener installation tools engage the distal end of an elongated. Two projection elements positioned in a plane on the installation tool and a channel between the projection elements further are positionable to provide a marker for a user during use to achieve an optimal installation location.

9 Claims, 19 Drawing Sheets

(56) References Cited

U.S. PATENT DOCUMENTS

| | | | | |
|---|---|---|---|---|
| 6,363,818 | B1 | 4/2002 | Habermehl | |
| 6,425,306 | B1 | 7/2002 | Habermehl | |
| 6,470,579 | B2 | 10/2002 | Allen | |
| 6,493,085 | B1 | 12/2002 | Pfeifer et al. | |
| 6,550,152 | B2 | 4/2003 | Myrick | |
| 6,647,836 | B1 | 11/2003 | Habermehl | |
| 6,729,522 | B2 * | 5/2004 | Hempfling | B25B 21/002 227/119 |
| 6,792,522 | B2 | 9/2004 | Hatakeyama et al. | |
| 6,862,963 | B2 | 3/2005 | Habermehl et al. | |
| 6,990,731 | B2 | 1/2006 | Haytayan | |
| 7,194,812 | B2 | 3/2007 | Davis | |
| 7,278,223 | B1 | 10/2007 | Dever et al. | |
| 7,341,146 | B2 | 3/2008 | Habermehl | |
| 7,530,175 | B2 | 5/2009 | Strutt et al. | |
| 7,987,608 | B2 | 8/2011 | Rowe | |
| 8,256,104 | B2 | 9/2012 | Fulbright | |
| 8,376,203 | B2 * | 2/2013 | Martel | B25B 23/06 227/15 |
| 8,403,194 | B2 | 3/2013 | Tebo | |
| 8,955,210 | B2 | 2/2015 | Vandenberg | |
| 9,144,896 | B2 | 9/2015 | Vandenberg | |
| 9,452,514 | B2 | 9/2016 | Guthrie et al. | |
| 10,792,794 | B2 | 10/2020 | Tillinghast et al. | |
| 2010/0213237 | A1 | 8/2010 | Tebo | |
| 2012/0204409 | A1 | 8/2012 | Vandenberg | |
| 2014/0161561 | A1 | 6/2014 | Tebo | |
| 2014/0304973 | A1 * | 10/2014 | Guthrie | B25B 21/00 29/525.11 |
| 2015/0101462 | A1 * | 4/2015 | Walters | B25B 21/00 81/451 |
| 2019/0366518 | A1 | 12/2019 | Tillinghast et al. | |
| 2020/0368883 | A1 | 11/2020 | Tillinghast et al. | |

OTHER PUBLICATIONS

GemRed 82302 Digital Level Angle Finder Protractor Goniometer with Metal Moving Blade & Vial(Professional Angle Finder(Accuracy 0.15 degree)), available from Amazon.

Johnson, 21" Digital Magnetic Level & Angle Locator with Dot Laser, Model 40-6065, Available from Johnson Level & Tool Mfg. Co. (accessed Nov. 6, 2017).

Johnson, Split Level Information (accessed Nov. 6, 2017).

* cited by examiner

METHODS FOR USING FASTENER INSTALLATION TOOLS

CROSS-REFERENCE

This application is a divisional application of application Ser. No. 15/991,099, filed May 29, 2018, entitled FASTENER INSTALLATION TOOLS, SYSTEMS, AND METHODS, which is incorporated herein by reference in its entirety, and to which application priority under 35 USC § 121 is claimed.

BACKGROUND

Field

The present disclosure relates to generally tools and methods for fastening structural members during construction. More specifically, the disclosed tools and methods install fasteners to wood framing components including trusses such as rafters, ridge boards, tie beams. chords, joists, top plates, posts, studs, and struts.

Background

Building codes are typically based on a set of universal building codes such as the International Residential Code and the International Building Code. The universal building codes set forth requirements for securing wooden framing components during construction. The codes typically require that the top plate and the roof trusses, such as rafters, be connected to comply with pre-established connection force standards calculated to resist substantial uplift forces that may be experienced throughout the lifetime of the structure. For locations which are susceptible to high wind uplift and/or seismic activity, a stronger force-resistant connection between the top plate and trusses may be required by local building codes. A number of techniques, fasteners and hardware items can be employed to provide the required connection between, for example, a top plate and the roof trusses.

To secure framing components with sufficient retentive force, each threaded fastener is, for example, driven through a top plate and into the rafter at about a 22.5 degree angle with respect to the vertical. Although securing multiple threaded fasteners is typically more efficient than attaching a hurricane clip or other strap-type connector, it is difficult to consistently implement a 22.5 degree angle within a reasonable range of precision. While protractors, levels and other tools can be used, in practice such tools are clumsy, difficult to use in the field, and time consuming.

There is a need for a tools and methods that facilitate the use of threaded fasteners to connect building framework components at a consistent angle which is easy to use.

The present disclosure addresses the need for tools and methods to efficiently installing multiple threaded fasteners having a consistently precise optimum connection angle.

SUMMARY

An aspect of the disclosure is directed to fastener installation systems. The fastener installation systems can be modular and enable a user to achieve installation of a fastening member without getting on a ladder. Suitable fastener installation systems are configurable for fastening a first member to a second member comprising: an elongated adapter having a proximal end and a distal end; a driver which generates torque mounted to a first end of the elongated adapter; a torque transfer unit engaging the elongated adapter and the driver to transfer torque produced by said driver to a fastener; and a fastener installation tool engaging the distal end of the elongated adapter having a body comprising: a first member wherein the first member has a substantially planar profile in a first plane; a positioning member formed integrally with the first member wherein the positioning member has a rocker positioned along a length of the positioning member between a channel face of the first member and a distal end of the positioning member on a first side; an axial channel passing from the distal end of the fastener installation tool to the proximal end; and at least one of a linear marker on an exterior surface of the body in the first plane and an angled marker on the exterior surface of the body in the second plane. The tube assembly can be a telescoping tube assembly. Additionally, the telescopic tube assembly can further comprise a keyway. In some configurations, the telescoping tube assembly comprises a first tubular member configurable to engage the driver and slidably engageable with a second tubular member. At least one of the first members has a notch at a distal end on a channel-facing side. A position indicator tool can also be provided. The position indicator tool can be configured to removably engaging the elongated adapter. Additionally, the position indicator tool can further comprises a pair of mounting members engaging a partially fluid filled vial. In some configurations, the position indicator tool further comprises a laser pointer. The driver can be one of a battery powered drill and a drill with an electrical cord. The rocker presents a curved surface along a plane of the fastener installation tool, In use, the rocker allows the fastener installation tool control an angle of installation by maintaining contact of the rocker on an installation surface while rotating the device relative to the installation surface.

Another aspect of the disclosure is directed to fastener installation tools. Suitable fastener installation tools are configurable to engage the distal end of the elongated adapter having a body comprising: a first member wherein the tangential member has a substantially planar profile in a first plane; a positioning member formed integrally with the first member wherein the positioning member has a rocker positioned along a length of the positioning member between a channel face of the first member and a distal end of the positioning member on a first side; an axial channel passing from the distal end of the fastener installation tool to the proximal end. In at least some configurations, at least one of the first members has a notch at a distal end on a channel-facing side. Additionally, the distal end of the first member is one of curved, flat, angled, and tapered. The positioning member can be configured to include a rocker positioned along a length of the positioning member between a channel face of the first member and a distal end of the positioning member on a first side. Additionally, the positioning member can have a second rocker positioned along a length of the positioning member between the channel face of the first member and the distal end of the positioning member on a second side. In at least some configurations, the rocker has an hourglass shape. At least one of the linear marker on an exterior surface in the first plane and the angled marker on the exterior surface in the second plane can be visually distinct from a remainder of the body of the fastener installation tool. Additionally, the linear markers can be positioned on a first side of the body and a second side of the body. In some configurations, the linear marker has a length greater than 50% of the length of the body of the fastener installation tool. The angled marker can also be positioned on a first side of the body and a second side of the body. In some configurations, the angled marker can be positioned proximal to the rocker.

Yet another aspect of the disclosure is directed to fastener installation tools configurable to engage a distal end of an elongated adapter. Suitable fastener installation tools have a body comprising: a first member wherein the engagement member has a substantially planar profile in a first plane; a positioning member formed integrally with the first member wherein the positioning member has a rocker positioned along a length of the positioning member between a channel face of the first member and a distal end of the positioning member on a first side; an axial channel passing from the distal end of the fastener installation tool to the proximal end. In some configurations, at least one of the first members has a notch at a distal end on a channel facing side. Additionally, the distal end of the first member is one of curved, flat, angled, and tapered. The positioning member can also have a second rocker positioned along a length of the positioning member between the channel face of the first member and the distal end of the positioning member on a second side. In some configurations, the rocker has an hourglass shape. Additionally, the tools can comprise at least one of a linear marker on an exterior surface of the body in the first plane and an angled marker on the exterior surface of the body in the second plane. At least one of the linear marker on an exterior surface in the first plane and the angled marker on the exterior surface in the second plane are visually distinct from a remainder of the body of the fastener installation tool. The linear marker can also be positioned on a first side of the body and a second side of the body. The linear marker can also have a length greater than 50% of the length of the body of the fastener installation tool. In some configurations, the angled marker is positioned on a first side of the body and a second side of the body. The angled marker can also be positioned proximal to the rocker.

Still other aspects of the disclosure are directed to removable position indicator tools. Suitable position indicator tools comprise: a semicircular body having a first end, a second end, a convex exterior surface, and a concave interior surface; a mounting member extending from the convex exterior surface; and wherein at least one of the first end and the second end has a tongue and groove shaped surface. In some configurations, a sealed vial secured by the mounting member and/or a laser pointer secured by the mounting member. Additionally, the position indicator tool can further comprise at least one flange. Additionally, the mounting member further comprises a first mounting member and a second mounting member and further wherein the first mounting member is positioned on the convex exterior surface in a first position and the second mounting member is positioned on the convex exterior surface in a second position offset by about 1.97 inch to the central axis of the removable position indicator tool.

Another aspect of the disclosure is directed to methods of installing fasteners to framing components. Methods include coupling a fastener installation tool of the disclosure to a driver. In some methods, the fastener installation tool can be coupled to an adapter which in turn is coupled to a driver. In still other methods, the fastener installation tool of the disclosure is coupled to a driver and separated from the driver by one or more extension components which are connected via one or more extension connectors. In still other methods, one or more position indicator tools can engage an adapter or an extension component. In use, the fastener installation tool of the disclosure can be used with a drive at a variety of distances away from a user, enabling the user to install fasteners at a plurality of distances without, for example, climbing on a ladder.

INCORPORATION BY REFERENCE

All publications, patents, and patent applications mentioned in this specification are herein incorporated by reference to the same extent as if each individual publication, patent, or patent application was specifically and individually indicated to be incorporated by reference.

ARMSTRONG CEILING SYSTEMS, Installation Manual for Lay-in Modular Ceiling;

GemRed 82302 Digital Level Angle Finder Protractor Goniometer with Metal Moving Blade & Vial;

JOHNSON, 21" Digital Magnetic Level & Angle Locator with Dot Laser, Model 40-6065;

CN 202922337-U published on May 8, 2013 by He Yong;

FR 3029128-A1 published on Jun. 3, 2016 by Gissinger et al.;

US 2010/0213237-A1 published on Aug. 26, 2010 by Tebo;

US 2012/0204409-A1 published on Aug. 16, 2012 by Vandenberg;

US 2014/0161561-A1 published on Jun. 12, 2014 by Tebo;

U.S. Pat. No. 3,864,839-A issued on Feb. 11, 1975 by Wolf;

U.S. Pat. No. 4,132,496-A issued on Jan. 2, 1979 by Casto;

U.S. Pat. No. 4,785,544-A issued on Nov. 22, 1988 by Heinsius et al.;

U.S. Pat. No. 4,922,621-A issued on May 8, 1990 by Maier;

U.S. Pat. No. 4,945,799-A issued on Aug. 7, 1990 by Knetzer;

U.S. Pat. No. 5,361,504-A issued on Nov. 8, 1994 by Huang;

U.S. Pat. No. 5,740,705-A issued on Apr. 21, 1998 by Graham;

U.S. Pat. No. 5,791,207-A issued on Aug. 11, 1998 by Ahdoot;

U.S. Pat. No. 6,109,145-A issued on Aug. 29, 2000 by Habermehl;

U.S. Pat. No. 6,301,997-B1 issued on Oct. 16, 2001 by Welte;

U.S. Pat. No. 6,363,818-B1 issued on Apr. 2, 2002 by Habermehl;

U.S. Pat. No. 6,425,306-B1 issued on Jul. 30, 2002 by Habermehl;

U.S. Pat. No. 6,470,579-B2 issued on Oct. 29, 2002 by Allen;

U.S. Pat. No. 6,493,085-B1 issued on Dec. 10, 2002 by Pfeifer et al.;

U.S. Pat. No. 6,550,152-B2 issued on Apr. 22, 2003 by Myrick;

U.S. Pat. No. 6,647,836-B1 issued on Nov. 18, 2003 by Habermehl;

U.S. Pat. No. 6,862,963-B2 issued on Mar. 8, 2005 by Habermehl et al.;

U.S. Pat. No. 6,990,731-B2 issued on Jan. 31, 2006 by Haytayan;

U.S. Pat. No. 7,194,812-B2 issued on Mar. 27, 2007 by Davis;

U.S. Pat. No. 7,278,223-B1 issued on Oct. 9, 2007 by Dever et al.;

U.S. Pat. No. 7,341,146-B2 issued on Mar. 11, 2008 by Habermehl;

U.S. Pat. No. 7,530,175-B2 issued on May 12, 2009 by Strutt et al.;

U.S. Pat. No. 7,987,608-B2 issued on Aug. 2, 2011 by Rowe;

U.S. Pat. No. 8,256,104 B2 issued Sep. 4, 2012 by Fulbright;

U.S. Pat. No. 8,376,203-B2 issued on Feb. 19, 2013 by Martel et al.;

U.S. Pat. No. 8,403,194-B2 issued on Mar. 26, 2013 by Tebo;

U.S. Pat. No. 8,955,210-B2 issued on Feb. 17, 2015 by Vandenberg;

U.S. Pat. No. 9,144,896-B2 issued on Sep. 29, 2015 by Vandenberg; and

U.S. Pat. No. 9,452,514-B2 issued on Sep. 27, 2016 by Guthrie et al.

BRIEF DESCRIPTION OF THE DRAWINGS

The novel features of the invention are set forth with particularity in the appended claims. A better understanding of the features and advantages of the present invention will be obtained by reference to the following detailed description that sets forth illustrative embodiments, in which the principles of the invention are utilized, and the accompanying drawings of which:

DETAILED DESCRIPTION

Fastener Installation Tools

Figure 1A:
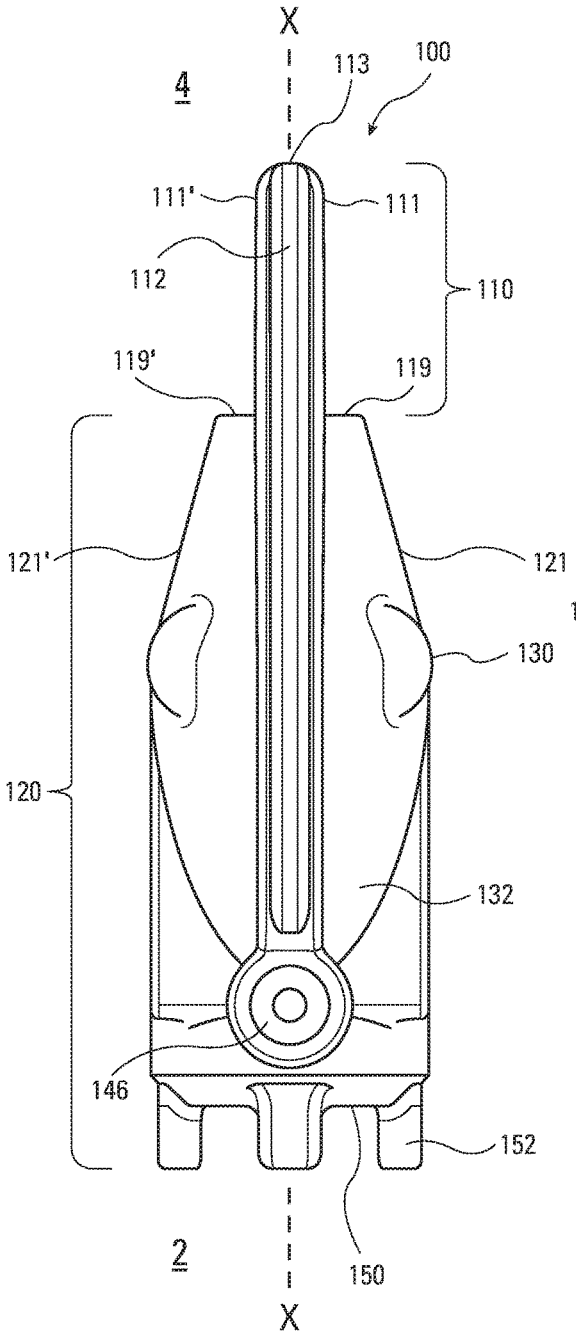
FIGS. 1A-F illustrate a fastener installation tool.

FIGS. 1A-F illustrate a fastener installation tool 100. FIG. 1A is a first planar view of the fastener installation tool 100. The fastener installation tool 100 has a proximal end 2 and a distal end 4. The distal end 4 has a first thickness in the first planar view of FIG. 1A that is different that the thickness of the proximal end 2 in the first planar view. The distal most end of the fastener installation tool 100 forms an engagement member 110 with an upper surface 111 and a lower surface 111'. Upper surface 111 and the lower surface 111' can be parallel to each other, or substantially parallel, when viewed in the first planar view. The length of the engagement member 110 is from about 0.90 inches to about 1.25 inches, preferably about 0.975 inches, and the thickness is from about 0.200 inches to about 0.400 inches, preferably about 0.300 inches.

The distal most end 113 of the engagement member 110 can be configured to have a rounded end (as shown). In another configuration, the distal most end 113 can be, for example, flat (e.g., an end which is perpendicular to the upper surface 111 and lower surface 111'), pointed, tapered, or angled. A linear marker 112 can be provided which forms a line along at least a portion of the length the fastener installation tool 100. The linear marker 112 can have a length that is, for example, 50% or greater of the overall length from the proximal end 2 to the distal end 4 of the fastener installation tool 100. The linear marker 112 can be achieved by using a surface treatment, applying a coating, or by over-molding. Thus, for example, achieving a result where the overall fastener installation tool 100 is one color (e.g., black) and the linear marker 112 is another color (e.g., orange). The linear marker 112 is configured to be visually distinct from the remainder of the fastener installation tool 100.

The proximal end 2 of the engagement member 110 is formed integrally with a positioning member 120 such that the proximal end 2 is either made from one piece with the positioning member 120 or operates as a single piece when the fastener installation tool 100 is in a final assembly. The positioning member 120 increases in thickness at a neck 119, 119'. Each side of the positioning member 120 has a substantially flat positioning member 121, 121'.

A rocker 130 is positioned approximately halfway along the length of the positioning member 120 between the proximal end 2 to the distal end 4. An angle θ is an angle at which the fastener is installed (see FIG. 5E). The measure of the angle is proportionate to a distance between the rocker 130 contact location and the distal end 113. As would be appreciated by those skilled in the art, the size and position of the rocker is relative to the size and position of the engagement member 110.

The rocker 130 forms a curved surface that extends from the substantially flat surface of the flat positioning member 121, 121'. The rocker 130 can be a curved surface, as illustrated, that provides a fulcrum which allows the fastener installation tool 100 to be positioned with respect to the target surface, such as a rafter. This allows the user to pivot the distal end 4 of the fastener installation tool 100 back-and-forth along an axis from the proximal end 2 to the distal end 4. A tongue and groove shape 150, 152 can be provided at the proximal end 2 of the fastener installation tool 100. The tongue and groove shape 150, 152 can be used, for example, to align the fastener installation tool with a level tool such as those shown in FIGS. 2-3.

An aperture 146 is provided that passes from one side of the fastener installation tool 100 to the opposing side. The aperture 146 allows an attachment member, such as a screw, to pass through. The aperture 146 can be positioned at a 90 degree angle from the longitudinal axis of the fastener installation tool 100 or at an angle 90 degrees from what is shown. The aperture 146 allows, for example, a screw to pass through to secure the fastener installation tool 100 to the telescoping member.

The length of the positioning member 120 is from about 2.0 inches to about 4.0 inches, preferably about 3.0 inches. The thickness of the positioning member 120 is from about 0.40 inches to about 0.75 inches, preferably about 0.610 inches, at its distal end and from about 0.90 inches to about 1.125 inches, preferably about 1.115 inches, at its proximal end. The rocker 130 extends from the surface of the positioning member from about 0.40 inches to about 0.75 inches, preferably about 0.565 inches. Typically, the dimensions are proportional, such that the distance between the points of contact with, for example, the stud, result in a predetermined angle of installation. A suitable range for angle of installation is, for example, between 4 and 14 degrees when a rafter is centered over a stud.

Figure 1B:
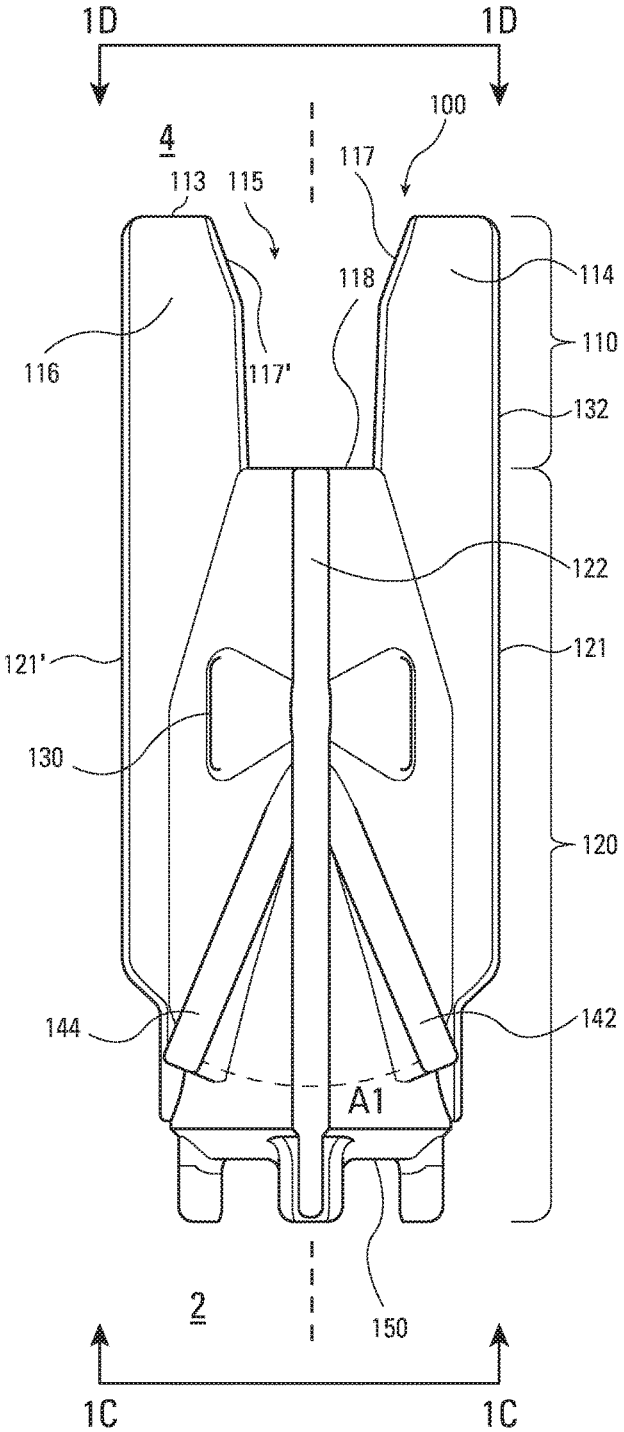

FIG. 1B is a planar view of the fastener installation tool 100 rotated perpendicularly 90 degrees about the x axis of the view of FIG. 1A, where the x axis refers generically to an axis which can be in any of the x-y-z direction. The engagement member 110 which appears as a solid member in the first plane shown in FIG. 1A has projections 114, 116 with a channel 115 in between the projections 114, 116 in a second plane. The channel 115 between the projections 114, 116 has a channel face 118 at the proximal end. The channel face 118 can be perpendicular to the projections 114, 116. Additionally, the projections 114, 116 can have parallel, or substantially parallel, sides which face each other within the channel 115 as illustrated. In other configurations the projections 114, 116 are not parallel. The channel 115 has a length of about 0.75 inches to about 1.115 inches, preferably about 0.975 inches, from the distal end of the fastener installation tool 100 and a width of about 0.30 inches to about 0.40 inches, preferably about 0.500 inches, between the projections 114, 116. Other shapes of the channel face 118 can be employed without departing from the scope of the disclosure including but not limited to convex, concave, sloped, and angled. The distal end 4 of the projections 114, 116 can have an interiorly positioned notch 117, 117' on one or both projections 114, 116 facing into the channel 115. The positioning member 120 has a pair of angled markers 142, 144. The pair of angled markers 142, 144 can be achieved by surface treatment, applying a coating, or over-molding. Thus, for example, achieving a result where the overall device is one color (e.g., black) and the angled markers 142, 144 are another color (e.g., orange). The pair of angled markers 142, 144 are configured to be visually distinct from the remainder of the fastener installation tool 100. The angle A1 between the angled markers 142, 144 is from about 35 degrees to about 55 degrees, preferably about 45 degrees. The angled markers 142, 144 are angled to a degree off of a linear axis between the proximal end 2 and the distal end 4 to allow the user to visually determine when one of the angled markers 142, 144 is parallel to a vertical member or parallel a horizontal member (shown in FIG. 5).

Figure 1C:
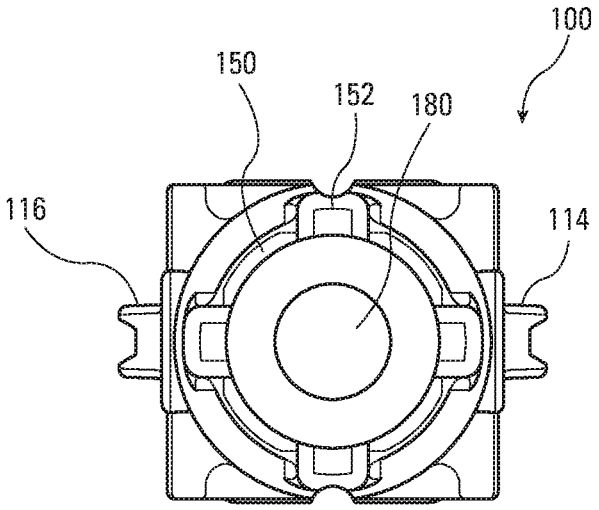

FIG. 1C is a view of the fastener installation tool 100 of FIGS. 1A-B from the proximal end 2. An axial channel 180 which passes through the fastener installation tool 100 from the proximal end 2 to the distal end 4 is provided through which a fastener (shown in FIG. 5) passes during use of the fastener installation tool 100.

Figure 1D:
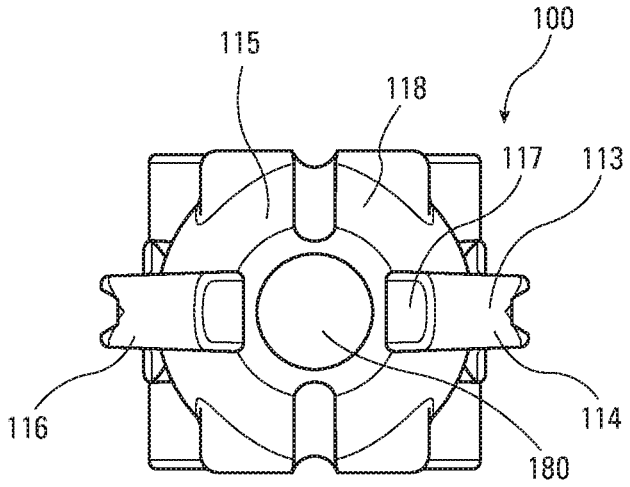

FIG. 1D is a view of the fastener installation tool 100 of FIGS. 1A-B from the distal end 4 down the axial channel 180.

Figure 1E:
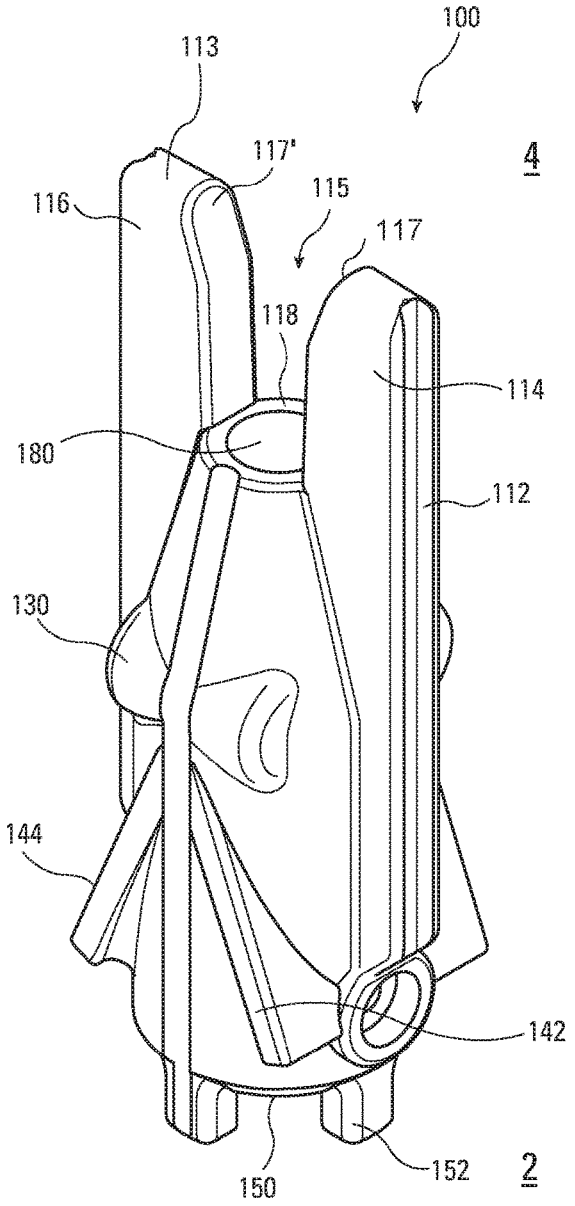
Figure 1F:
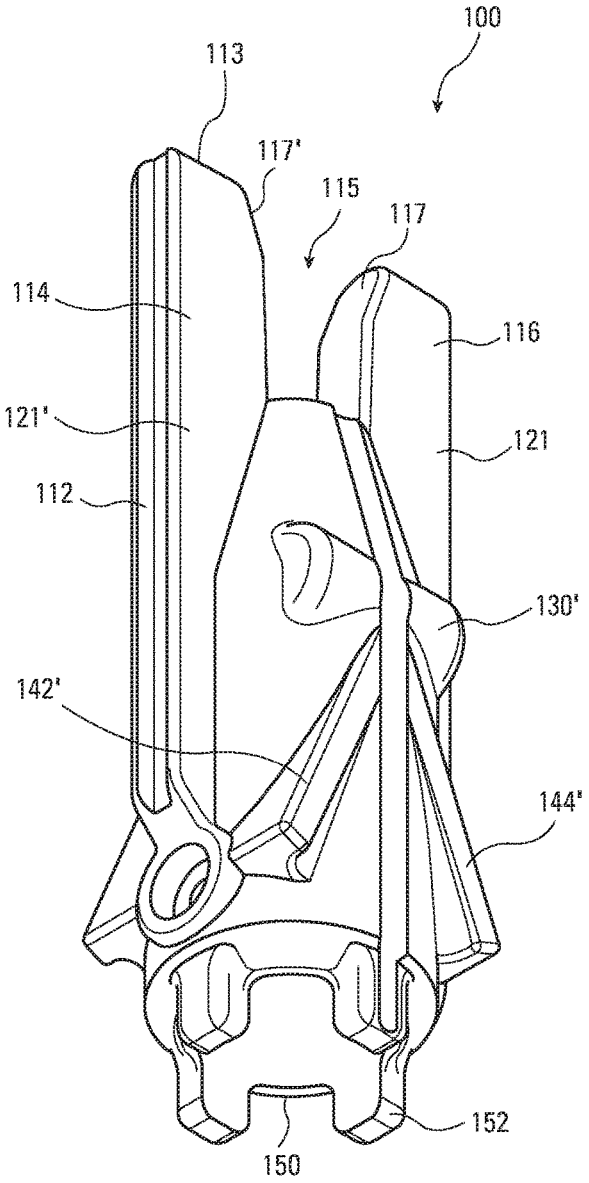

FIGS. 1E-F are perspective views of the fastener installation tool 100 of FIGS. 1A-B.

Position Indicator Tools

FIGS. 2A-D illustrate a configuration of position indicator tool such as a level tool 200. The level tool 200 is configured to removably engage a tubular member 412 (shown in more detail in FIG. 4). The level tool 200 has a length of from about 1.60 inches to about 2.10 inches, preferably about 1.886 inches, and a diameter of from about 0.90 inches to about 1.30 inches, preferably about 1.115 inches. The level tool 200 has a partial tubular shape having a curved interior surface which has an open end 202 along a length to allow the level tool 200 to engage a tubular member 412 as shown in FIG. 2. The curved interior surface (shown in FIG. 2D) has a length that is substantially the same as the overall length of the level tool 200, and a diameter across a mid-line of about 0.6 inches to about 1.2 inches, preferably about 0.875 inches. The partial tubular shape can be from about 225 degrees of a 360 degree circle to about 275 degrees of a 360 degree circle, preferably about 250 degrees. Other shapes can be used without departing from the scope of the disclosure.

A flange 250, 250' can be provided on either side of the open end 202 of the level tool 200 (i.e., the end that engages the tubular member 412). Either or both flanges 250, 250' which present a tongue and groove interface can extend along the entire length of the open end 202 of the level tool 200. Flanges can be provided for ease of attachment to the tubular member. A bubble level is positioned on an exterior surface 204 of the level tool 200. The bubble level has a vial 230 which is slightly curved and held by mounting members 210, 220 on either side of the vial 230.

The mounting members 210, 220 extend from an exterior surface of the level tool 200. As illustrated, the mounting members 210, 220 are not parallel one another on the exterior surface 204. However, the mounting members 210, 220 can be parallel in some configurations. The mounting members 210, 220 are configurable to have a common axis through their center. One mounting member 210 is closer to the proximal end 2 while the other mounting member 220 is farther away from the proximal end 2 and closer to the distal end 4. The spacing between the mounting members 210, 220 is such that a user has an unobstructed view of the bubble 240 in the vial during operation when the fastener installation tool 100 is at an optimum position for installing the fastener and an obscured view when the fastener installation tool 100 is not at an optimum position for installing the fastener.

The vial 230 can be a curved glass or plastic vial. The vial 230 is incompletely filled with a liquid. Suitable liquid for the vial can be a colored liquid, such as a colored alcohol. The vial has a slight upward curve so that a bubble 240 in the fluid naturally rests at a center position along the length of the vial 230 when an axis of the vial 230 between an end engaging a first mounting member 210 and an end engaging a second mounting member 220 is either horizontal or vertical to, for example, a top plate 20 or a vertical stud 30 (shown in FIG. 5). At slight inclinations, the bubble 240 travels away from center position of the vial 230 toward a first end or second end of the vial 230. Movement of the bubble 240 within the vial 230 helps the user determine when a horizontal (level) or vertical (plumb) position has been achieved. An end of the level tool 200, such as the distal end 4, can have a tongue and groove 252 shape. The tongue and groove shape 252 can be used to align the level tool 200 with, for example, a fastener installation tool 100 of FIG. 1. In other configurations, the end of the level tool 200 can be flat. FIG. 6 illustrates a level tool 200 which has a tongue and groove shape 252 on both ends of the tool. The proximal end of the tongue and groove 252 can be configured to engage a handle 610 as illustrated in FIG. 6.

Figure 2A:
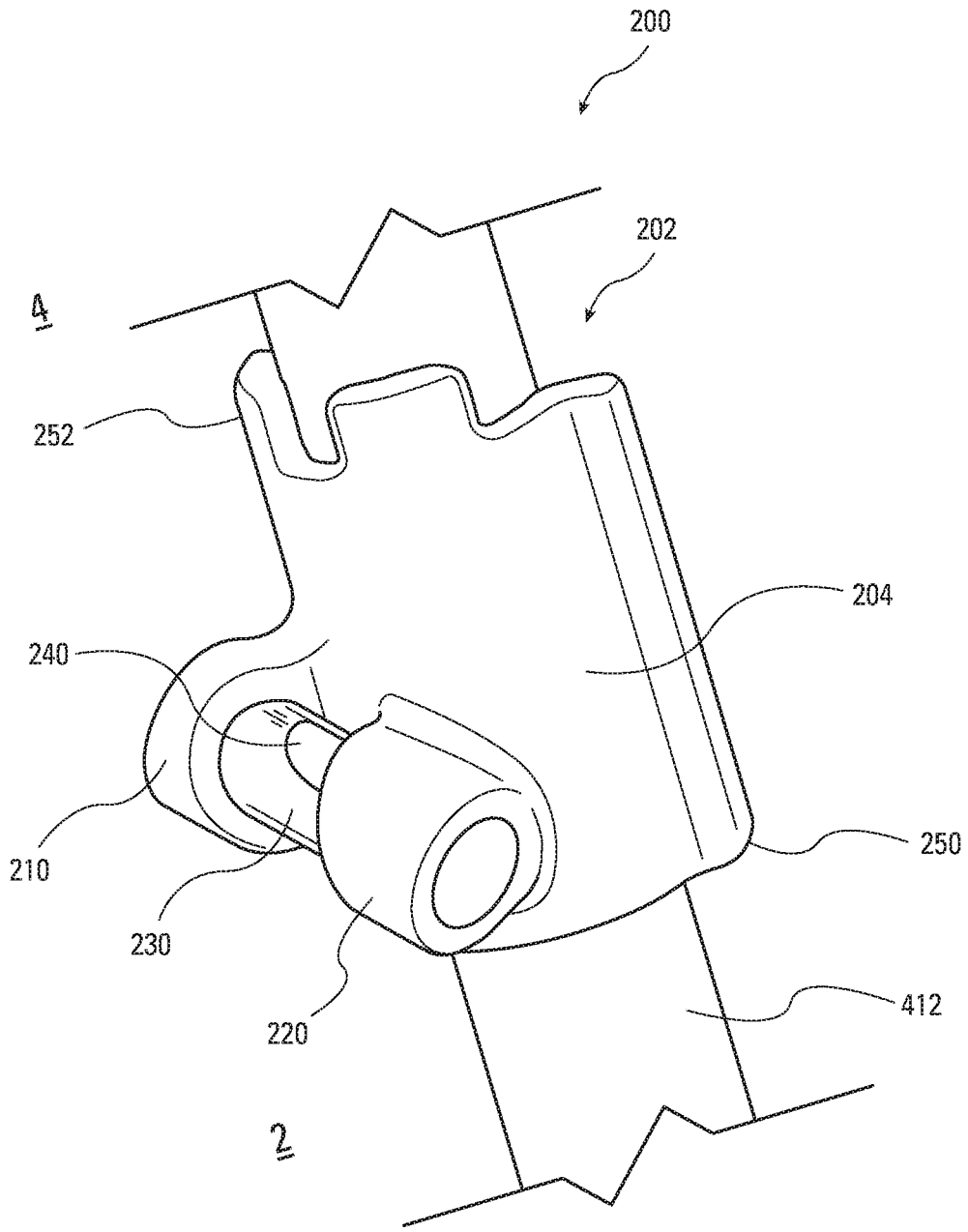
FIGS. 2A-D illustrate a configuration of a level tool.
Figure 2B:
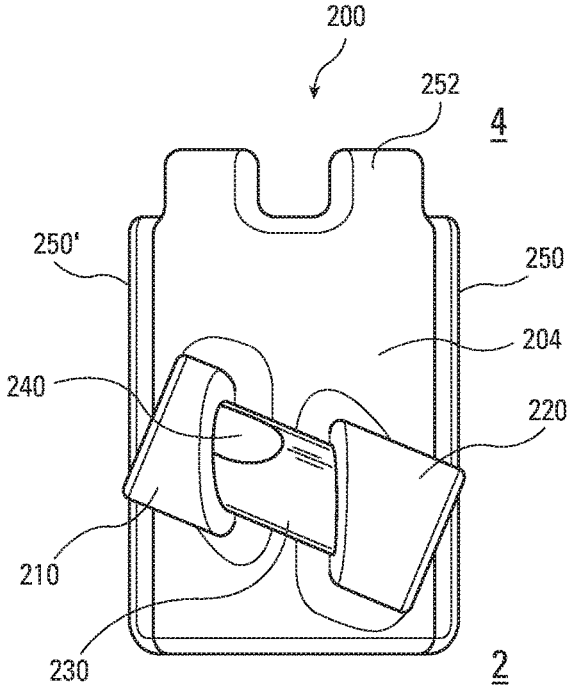
Figure 2C:
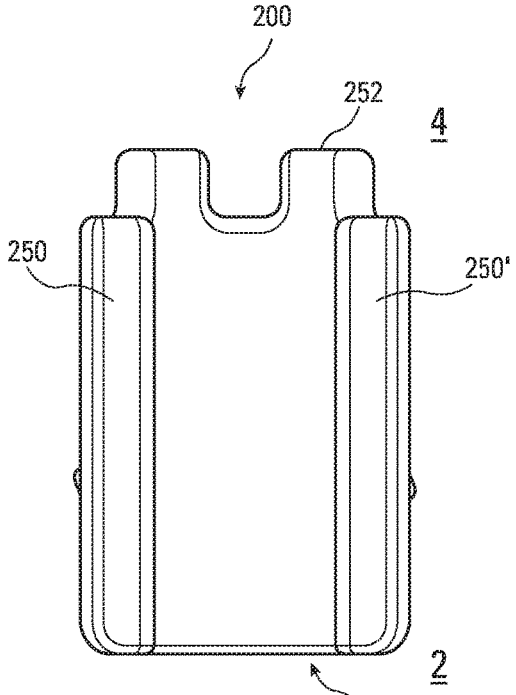
Figure 2D:
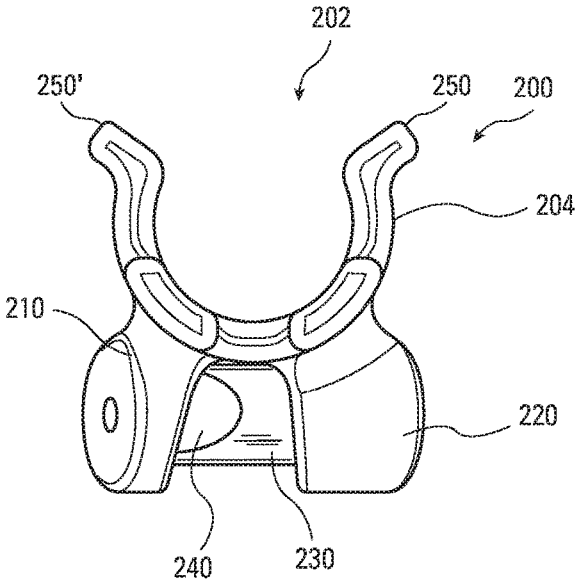

FIG. 2B is a view of the level tool 200 of FIG. 2A from a first side showing a convex curved exterior surface and the offset positioning of the mounting members 210, 220. FIG. 2C is a view of the level tool 200 of FIG. 2A from a second side showing a concave curved interior surface. FIG. 2D illustrates the level tool 200 rotated 90 degrees from the view in FIG. 2B. From this view, the open end 202 with its semi-circular shape and flanges 250 that extend away from a centerline is apparent.

The mounting members 210, 220 can form an inverted "V" or "U" when viewed from the side as shown in FIG. 2D. This orientation of the mounting members 210, 220 allows as much light as possible to pass through the vial, which provides for better visibility of the bubble for the user. In some configurations, a symmetrical part can be used from the right and the left which allows the flanges forming a tongue and groove surface to be positioned on both sides of the level tool 200.

FIGS. 3A-D illustrate a configuration of a position indicator tool 300. The position indicator tool 300 is configured to removably engage a tubular member 412 as shown in FIG. 4. The position indicator tool 300 has a length of from about 1.60 inches to about 2.20 inches, preferably about 1.886 inches, and a diameter of from about 0.80 inches to about 1.20 inches, preferably about 1.0 inches. The position indicator tool 300 has a partial tubular shape having a curved interior surface which has an open end 302 along a length to allow the position indicator tool 300 to engage a tubular member 412 as shown in FIG. 4. The curved interior surface (shown in FIG. 3D) has a length of about 1.60 inches to about 2.20 inches, preferably about 1.886 inches, and a diameter across a mid-line of about 0.50 inches to about 1.0 inches, preferably about 0.75 inches. The partial tubular shape can be from about 225 degrees of a 360 degree circle to about 275 degrees of a 360 degree circle, preferably about 250 degrees. Other shapes can be used without departing from the scope of the disclosure.

A flange 350, 350' can be provided on either side of the open end 302 of the level tool 300. Either or both flanges 350, 350' can extend along the entire length of the open end 302 of the position indicator tool 300. A laser element 330 is positionable within mounting 320. The mounting 320 is positioned on a connecting member 328 which is integrally formed on the exterior surface 304 of the position indicator tool 300. The height of the laser element is such that the laser light still appears on the truss or rafter when the screw is being installed as described below in FIG. 5C. The ability to continue to visualize the laser light enables the user to ensure accurate placement of the fastener.

Figure 3A:
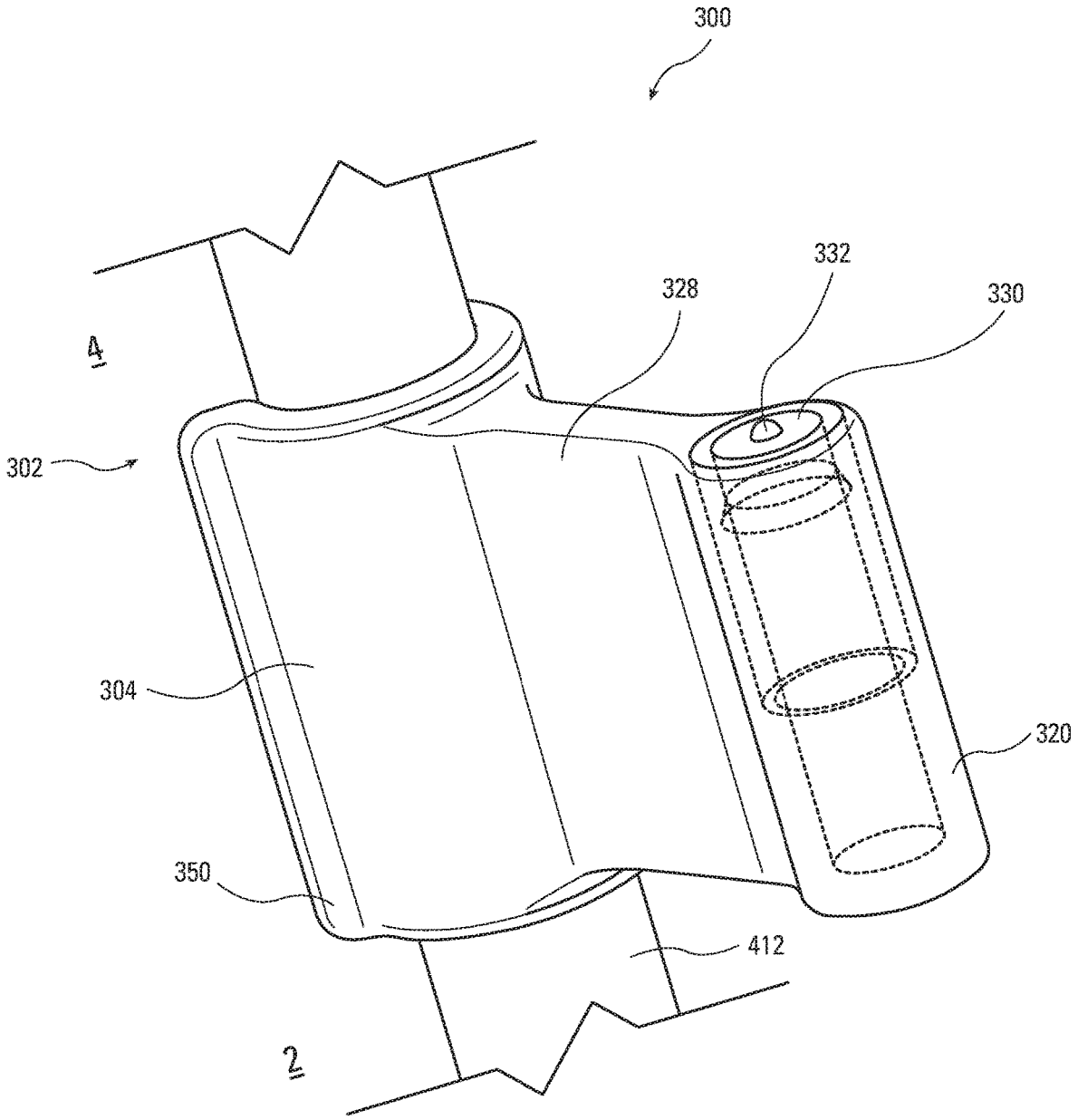
FIGS. 3A-D illustrate another configuration of a level tool.
Figure 3B:
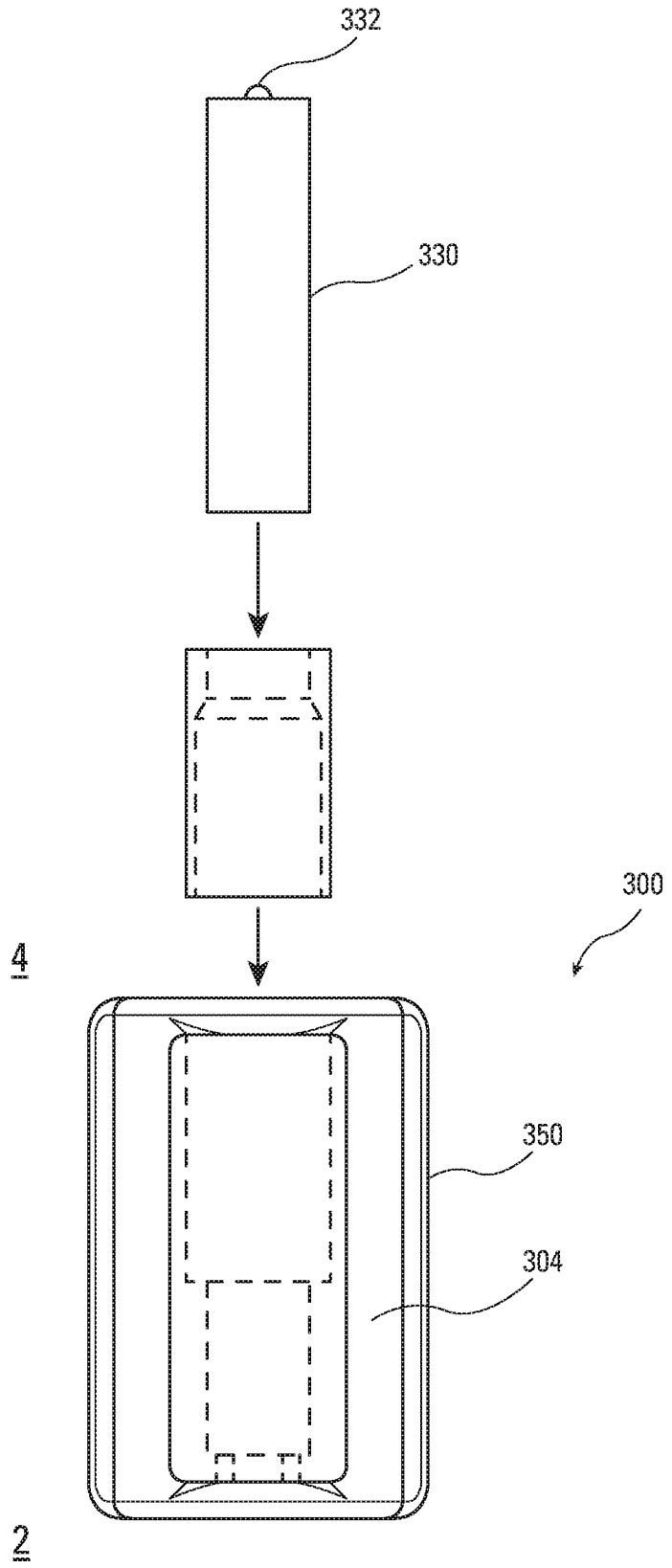

FIG. 3B is a view of the position indicator tool 300 of FIG. 3A from a first side showing a convex curved exterior surface. As shown in FIG. 3B the laser element 330 extends beyond the upper surface of the mounting 320. To activate the laser element 330, the laser element 330 is pushed out of the mounting 320. As will be appreciated by those skilled in the art, activation of the laser can be achieved a variety of ways. In one embodiment, the whole laser element is pushed from, for example, the bottom so that it extends out of the housing. The step of pushing the laser element turns on the light. The step of pushing the laser back into the housing turns off the laser light. In another configuration, a switch element can be provided which is activated when the fastener installation tool engages a work surface. Removal of the fastener installation tool from the work surface would then turn off the laser light. In another configuration, a switch can be provided on the handle of the tool. In still another configuration, the light can be activated by twisting the mounting piece and the tool relative to one another. In still another configuration, a Bluetooth switch can be provided. In yet another configuration, a switch can be provided which is related to the spinning mandrel inside the tool. Spinning of the mandrel would activate the switch and turn on the laser.

Figure 3C:
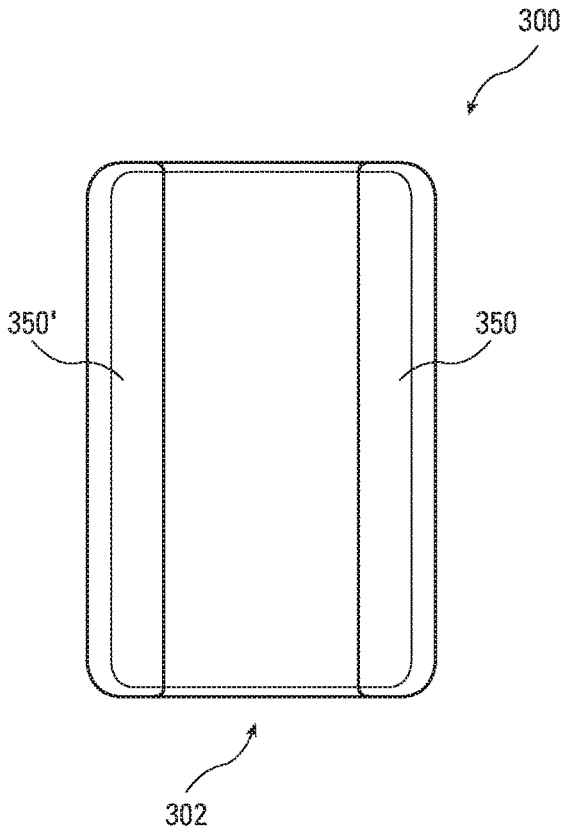
Figure 3D:
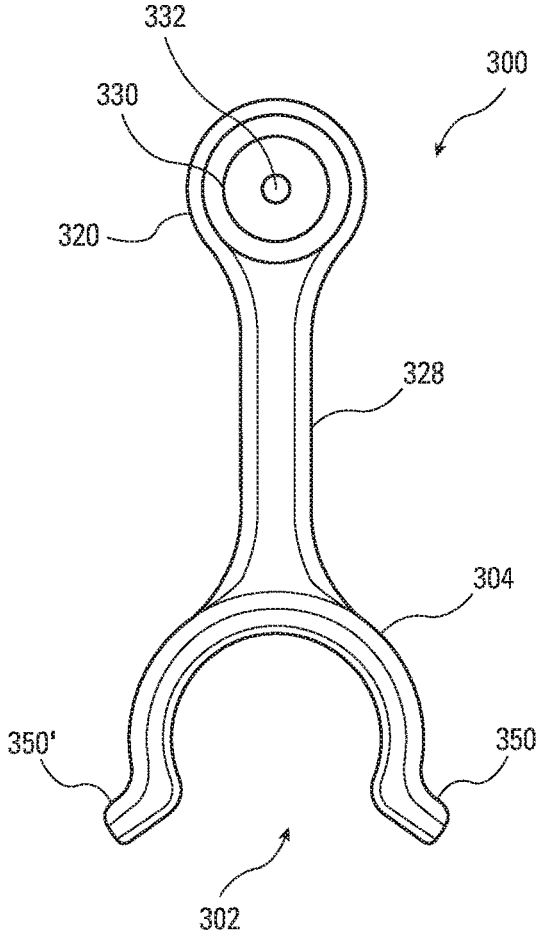

FIG. 3C is a view of the position indicator tool 300 of FIG. 3A from a second side showing a concave curved interior surface. FIG. 3D illustrates the position indicator tool 300 rotated 90 degrees from the view in FIG. 3B. From this view, the open end 302 with its semi-circular shape and flanges 350 that extend away from a centerline is apparent. The position indicator tool 300 could also have tongue and groove features as shown on the bubble level mount.

Telescoping Adapters

Figure 4A:
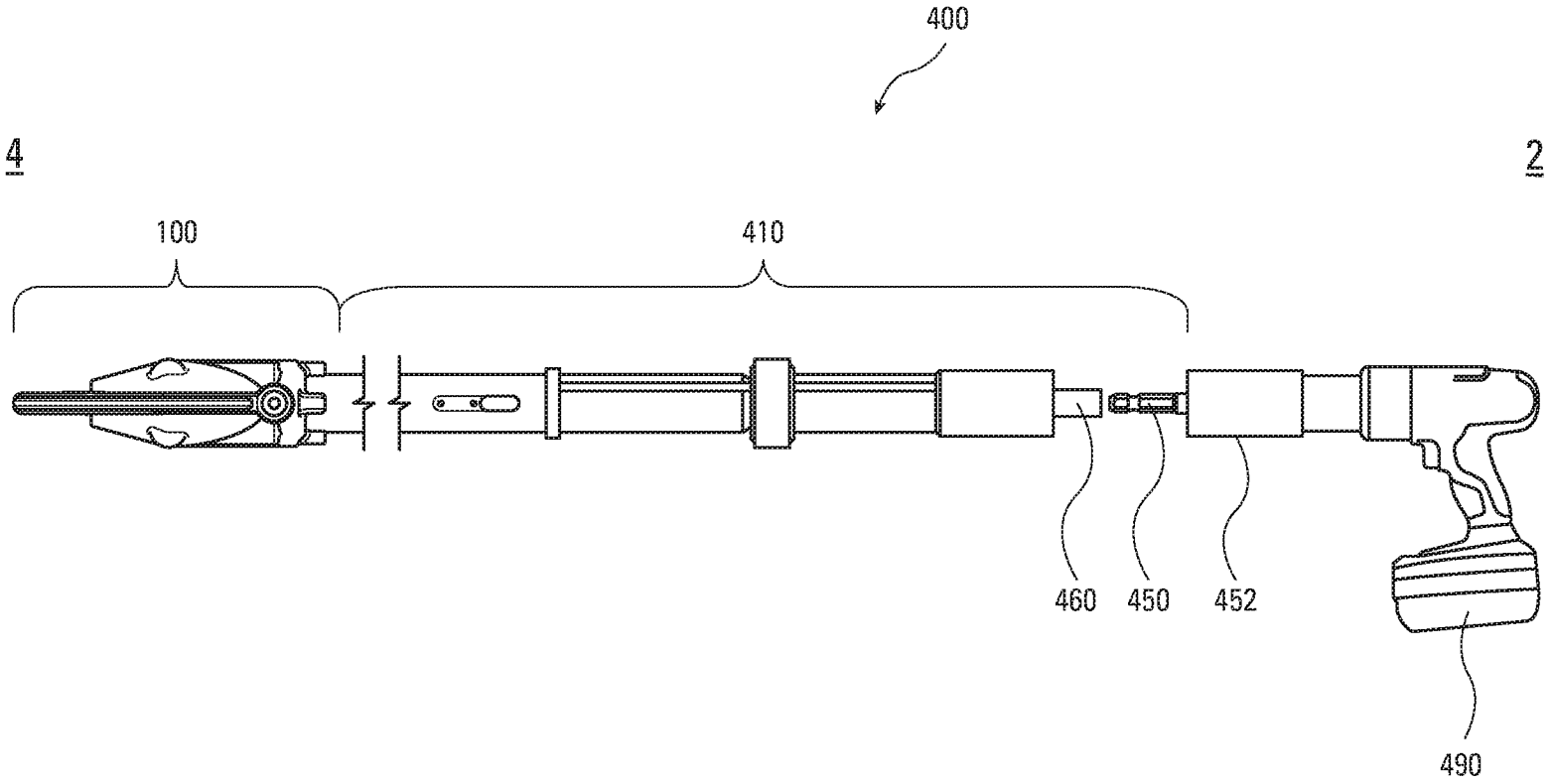
FIG. 4A illustrates the fastener installation tool with a driver and a telescoping adapter.

FIG. 4A illustrates the fastener installation tool 100 with a driver 490 and a telescoping adapter 410. The fastener installation tool 100 engages the telescoping adapter 410 at a distal end 4. The proximal end 2 of the telescoping adapter 410 engages the driver 490. The driver 490 is any suitable tool, such as a heavy-duty hand tool. Suitable heavy duty tools include, for example, power drills.

Figure 4B:
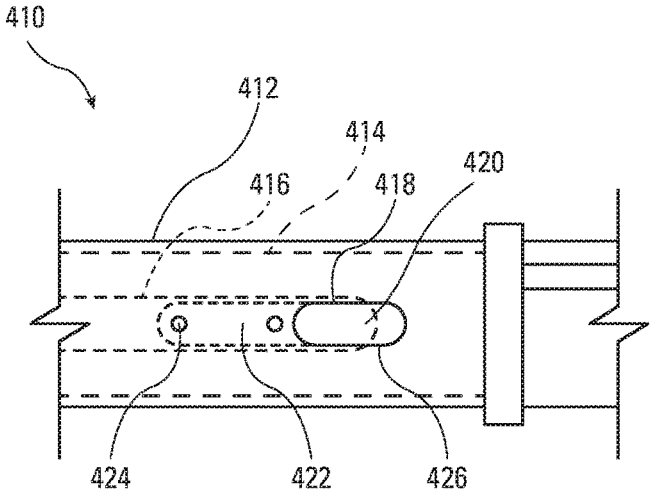
FIG. 4B is a close-up of a portion of the telescoping adapter.

FIG. 4B is a close-up of a portion of the telescoping adapter 410. The telescoping adapter has a first tubular member 412 and a second tubular member 414 that fits within the interior of the first tubular member 412. The first tubular member 412 can have a larger diameter than the second tubular member 414. The two tubular members can be keyed to control movement of the first tubular member 412 with respect to the second tubular member 414. The keyed feature can act as a forward and backward stop position. An elongated channel 416 or slot is formed in the second tubular member 414. A keying member 420 is provided which has an elongated body 422 to fit within the elongated channel 416 and a raised element 420 which is sized to fit within an aperture 418 in the first tubular member 412. The elongated body 422 of the keying member 420 is passed through the aperture 418 in the first tubular member 412. The elongated body 422 is configured to sit within the elongated channel 416. Once the elongated body 422 is positioned within the elongated channel 416, the raised element 420 sits within the aperture 418. The top surface 426 of the raised element 420 can be flush with the exterior surface of the first tubular member 412 or extend above the exterior surface of the first tubular member 412. One or more securement devices (not shown), such as screws, can be used to secure the keying member 420 securely in position. The securement devices would pass through the apertures 422, 424 in the first tubular member 412 and the keying member 420.

Figure 4C:
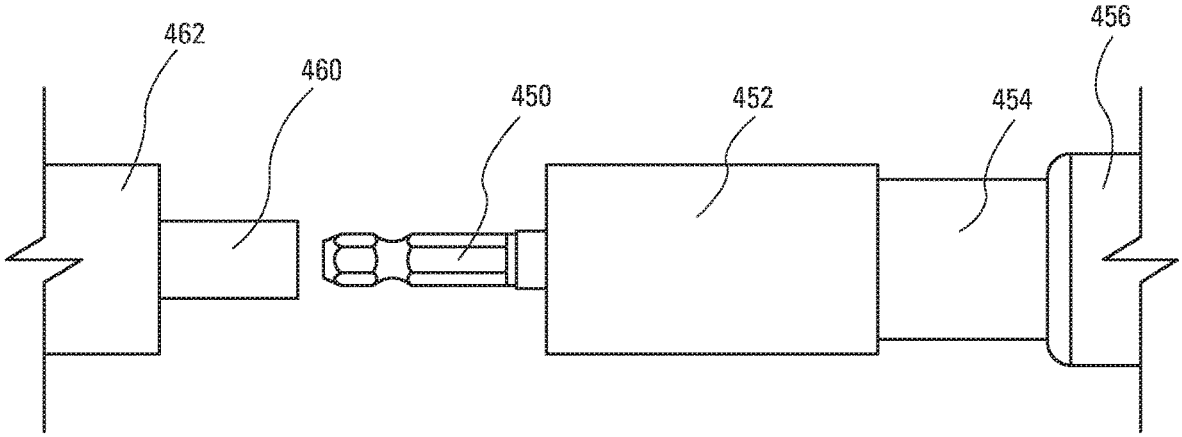
FIG. 4C is a close-up of a proximal end of the telescoping adapter.

FIG. 4C is a close-up of a proximal end 2 of the telescoping adapter 410. A drill chuck 460 engages the mandrel 450 which spins freely within the telescoping tube 454.

Figure 4D:
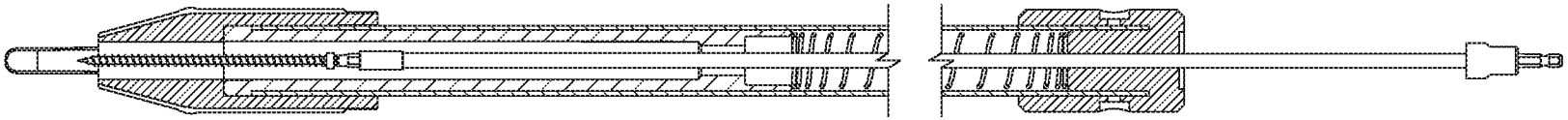
FIG. 4D is a cross-section of the fastener installation tool of FIG. 4A.

FIG. 4D shows a cross-section of the telescoping adapter 410 with the mandrel 450 at the proximal end and the bit 452 towards the distal end, where the bit 452 engages the fastener 80.

Use of Devices and Systems

FIGS. 5A-E illustrate fastener installation tools in use when installing fasteners to, for example, wood framing components. The projections 116 act as forks to stabilize the tool during use while the fastener is being driven into, for example, the rafters.

Figure 5A:
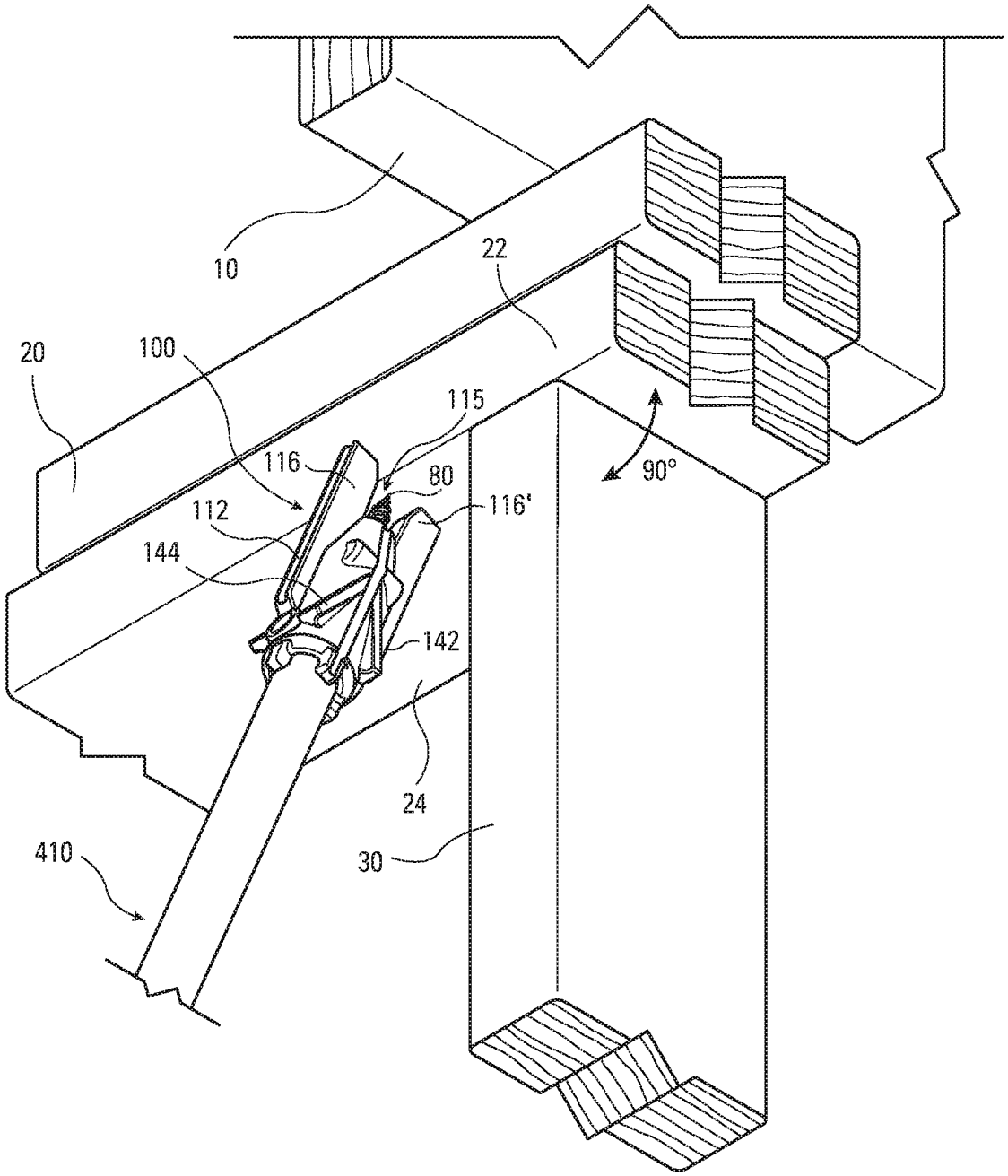
FIGS. 5A-E illustrate fastener installation tools in use.

As shown for illustration in FIGS. 5A-D, a rafter 10 is adjacent a top plate 20. A vertical stud 30 engages the top plate 20 at a 90 degree angle. Movement of the fastener installation tool 100 changes the orientation of the angled markers 142, 144 so that one of the markers is parallel to either the top plate 20 or the vertical stud 30. As shown in FIG. 5A, the angled marker 142 is positioned approximately parallel to the vertical stud 30. Because the angled marker 142 is visually distinct from the body of the fastener installation tool 100, the user can readily assess the position of the marker 142, for example, to the vertical stud 30. The front face of the top plate 20 and the stud 30 are essentially flush. The angled markers 142 provide a visual references, for example, to the target surface. Positioning either of the angled markers 142 so that they are vertical, for example, ensures a correct angle of installation of the screw 80. Further, the angled markers 142 can be visually compared to other vertical surfaces or edges within the line of sight by the user. Another feature of the design is that the interiorly positioned notches 117, 117' are angled to allow easy and comfortable engagement with the top plate 20 as shown in FIG. 5A. This provides tactile feedback to the user that the tool is positioned securely.

In FIG. 5A, the fastener installation tool 100 attached to a telescoping adapter 410 engages a side surface 22 of a top plate 20 at an angle. The fastener installation tool 100 is positioned so that one of the interiorly positioned notches 117 of a projection 116 is positioned on the side surface 22 of the top plate 20 while the second projection 116' is positioned on the lower surface 24 of the top plate 20. The distal tip of the fastener 80 extends beyond the recessed face of the channel 115. The user can move the telescoping adapter 410 upward to change the angle of attack of the fastener installation tool 100 and the fastener 80. Additionally, the user can move the telescoping adapter 410 from side-to side to change the angle of attack of the fastener installation tool 100 and the fastener 80.

Figure 5B:
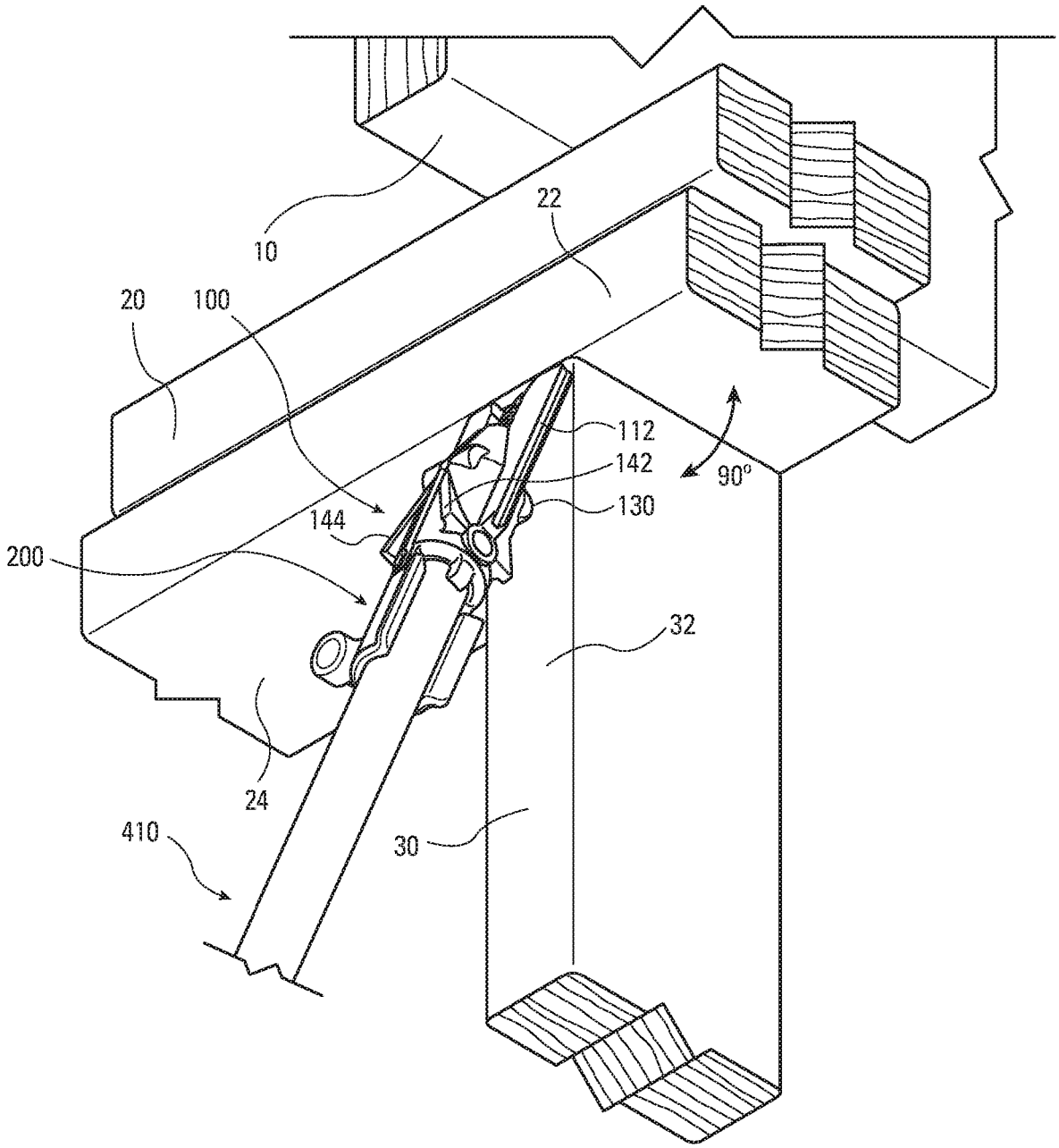
Figure 6:
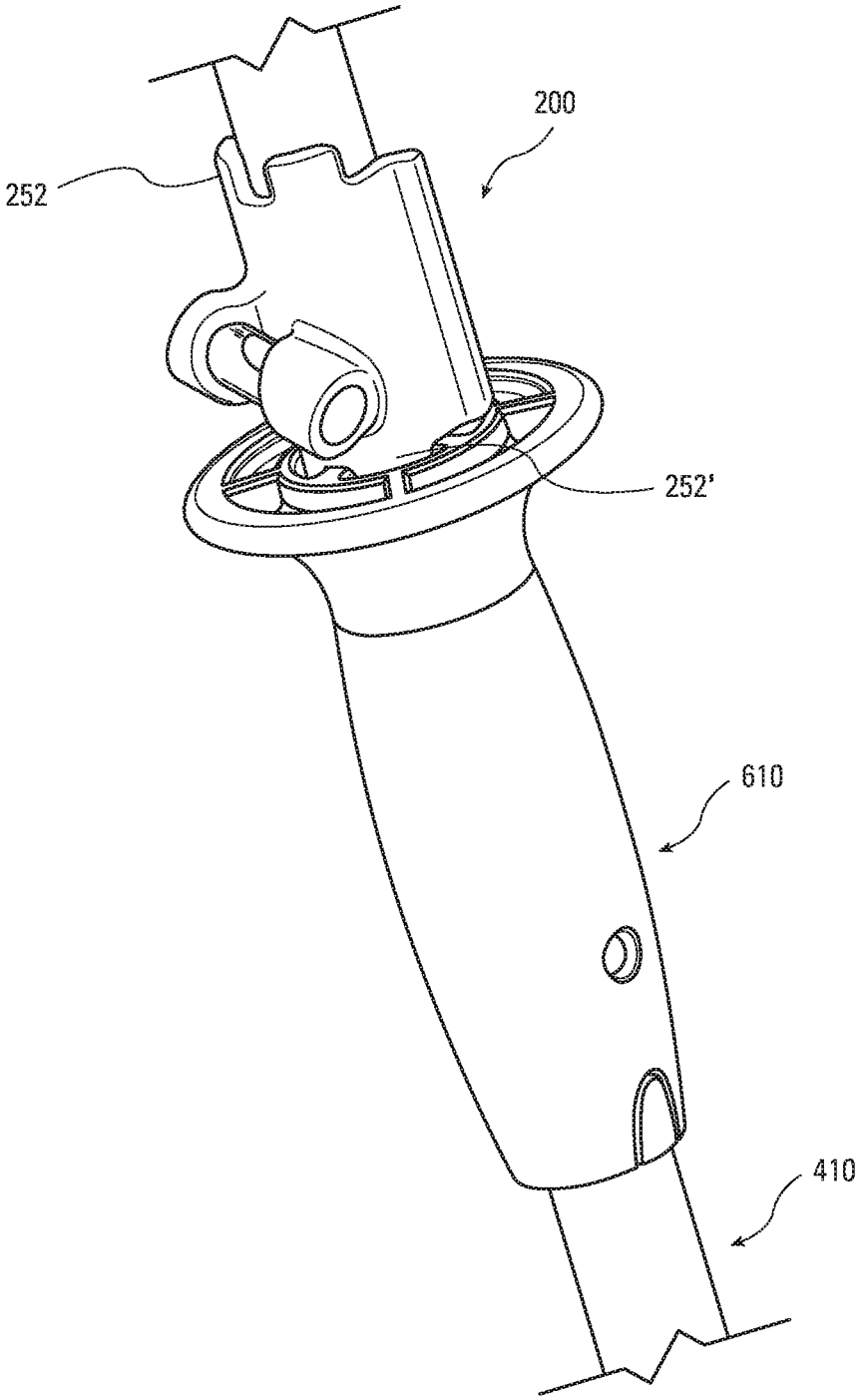
FIG. 6 illustrates a handle engaging a level tool at a proximal end.

Turning to FIG. 5B, the fastener installation tool 100 is shown attached to a telescoping adapter 410 turned 90 degrees from the deployment illustrated in FIG. 5A and at the intersection between the top plate 20 and the vertical stud 30. Additionally, a level tool 200 is positioned on the telescoping adapter 410 immediately below the fastener installation tool 100. In use, the user can move the telescoping adapted forward and backward so that a rocker 130 engages a surface 32 of the vertical stud 30. The level tool 200 is positioned so that the user can look up at the level tool 200 to determine whether the tool itself is at a desired orientation.

Figure 5C:
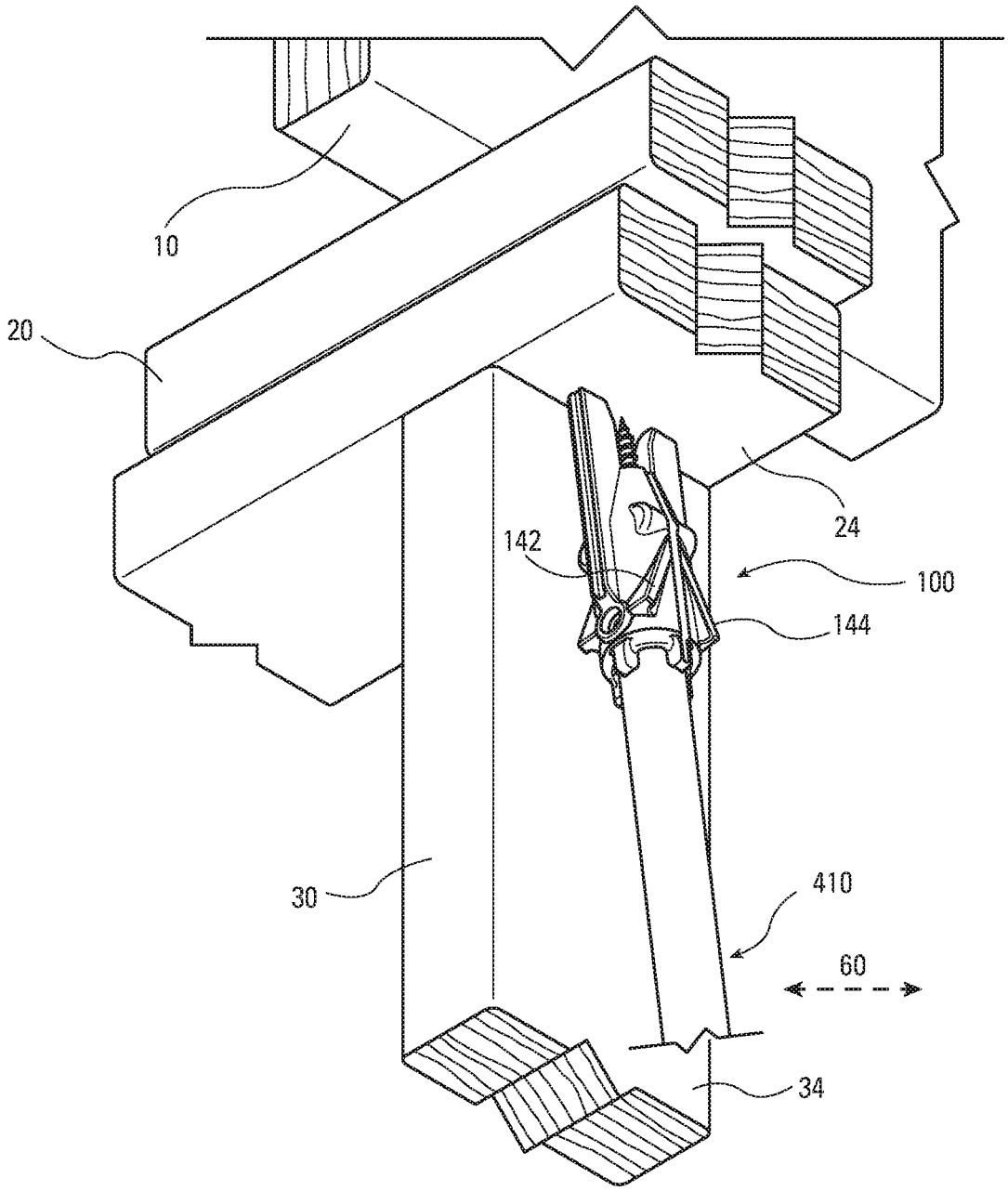

FIG. 5C illustrates the fastener installation tool 100 engaging a telescoping adapter 410. The fastener installation tool engages the top plate 20 on the lower surface 24 and the vertical stud 30 on a second surface 34. The rocker 130 and the visual indicator 112 allow the user to essentially aim for the center of the rafter. When the rafter is not centered over the stud, the user can utilize the rocker 130 engagement to quickly and easily adjust the angle of installation as needed. In some configurations, the telescoping adapter 410 and fastener installation tool 100 are moved towards and away 60 the vertical stud 30.

Figure 5D:
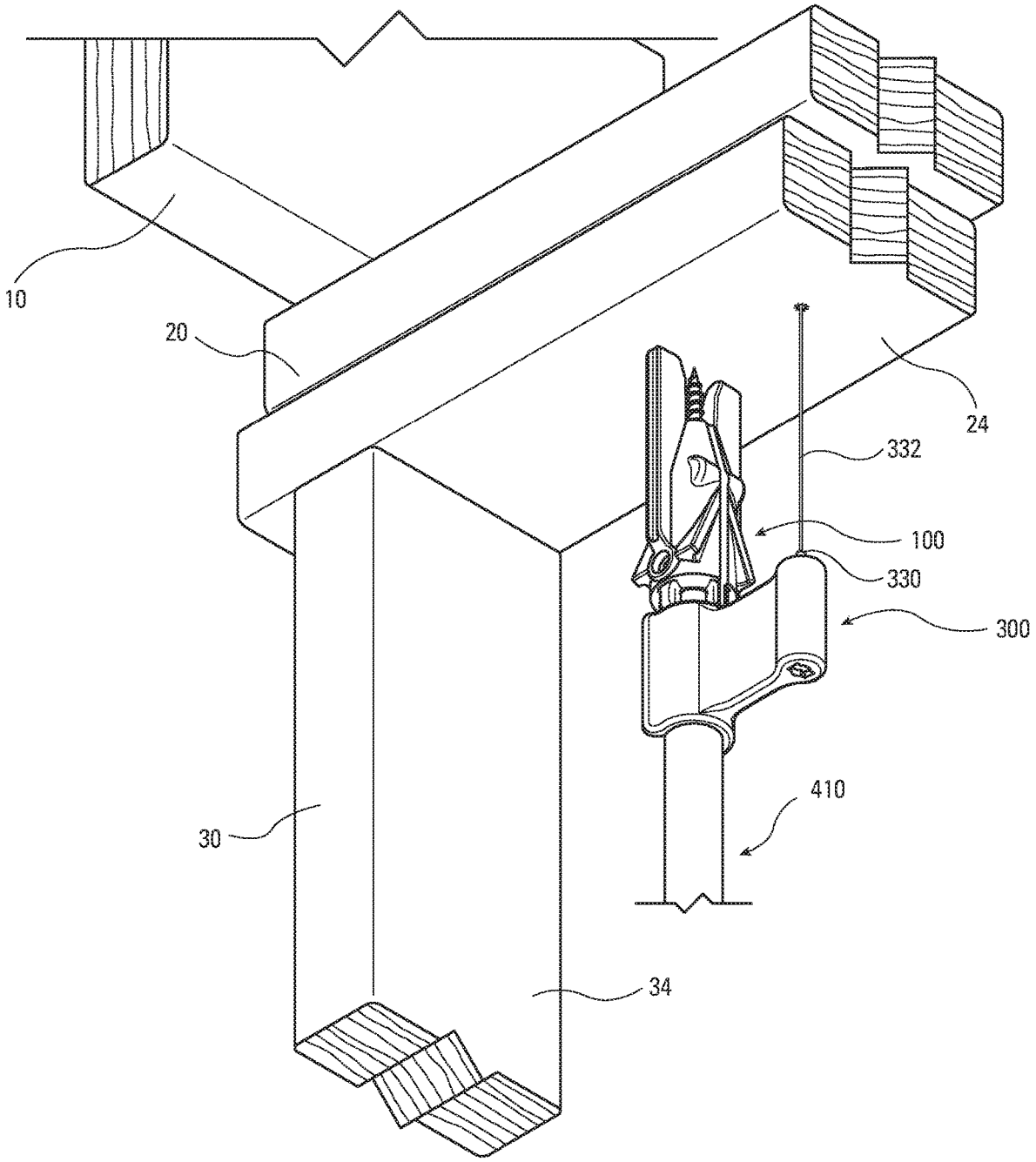

FIG. 5D illustrates the fastener installation tool 100 attached to a telescoping adapter 410. Additionally, a position indicator tool 300 is positioned on the telescoping adapter 410 immediately below the fastener installation tool 100. The fastener installation tool 100 is shown positioned away from the intersection between the top plate 20 and the vertical stud 30. In use, the laser element 330 is activated so that a light beam 332 is generated. The light beam 332 from the laser element 330 provides the user with visual feedback of the relative location of where the fastener will penetrate the top plate 20. For purposes of illustration, the position indicator tool 300 is shown below the lower surface of the top plate 20. However, in use the position indicator tool 300 would allow for installation from the side of a stud 30 and below a rafter 10. So the vertical installation illustrated is for ease of reference, as would be appreciated by those skilled in the art. In use, the position indicator tool 300 would allow for installation at angles other than perpendicular.

Prior to engagement of the fastener installation tool 100 with, for example, the top plate 20 of the roof support structure, a fastener 80 is placed into a fastener channel with the fastener head proximate to or engaging with a coupler. A portion of the fastener 80 is typically initially received in a chamber of the telescoping adapter 410 adjacent the distal end 4. A mandrel 450 is proximate the proximal opening of the telescoping adapter 410. It will be appreciated that the fastener installation tool 100 as properly positioned on the distal end 4 of the telescoping adapter 410 provides an entry point and for the fastener 80 as the fastener 80 is driven through the top plate 20 into the roof support member with the application of torque from the driver 490. The driver 490 can be easily dismounted from the telescoping adapter 410. The telescoping adapter 410 may employ a receiver configured to receive and functionally attach to a wide range of dismountable drill guns without the torque driver 490 being fully integrated with the telescoping adapter 410, as will be appreciated by those skilled in the art.

Figure 5E:
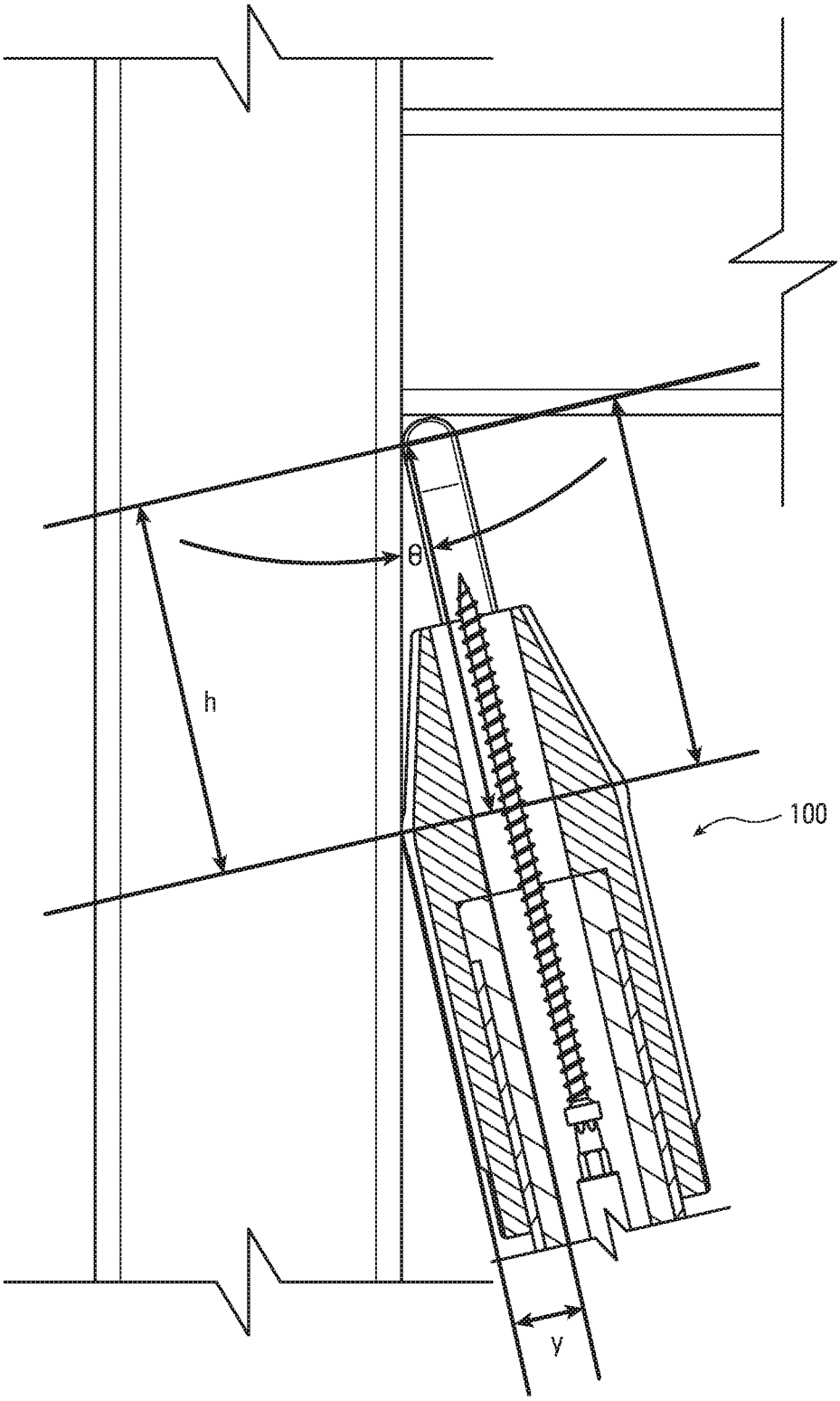

FIG. 5E is a close-up cut-away of the fastener installation tool 100 with the distal end engaging the top plate 20, and a side surface of the fastener installation tool 100 engaging the side of the vertical stud 30. The fastener is positioned in the central channel. h is a dimension that is parallel to the center axis of the tool and the fastener. y is the short side of the triangle formed between the vertical stud 30 and h, and 0 is the angle between the vertical member 30 and h.

Figure 7A:
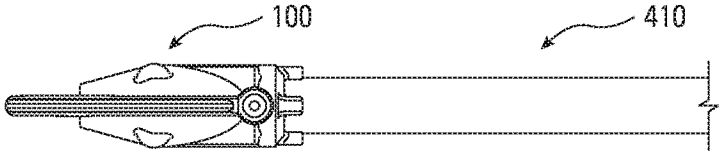
FIGS. 7A-E illustrate a fastener installation too connected to an adapter (FIG. 7A), the fastener installation tool removed from the adapter (FIG. 7B), the fastener installation tool engaging an extension without the adapter engaged (FIG. 7C), the fastener installation tool engaging both the extension and the adapter (FIG. 7D); and a cross-section of the fastener installation tool engaging the extension and the adapter (FIG. 7E).
Figure 7B:
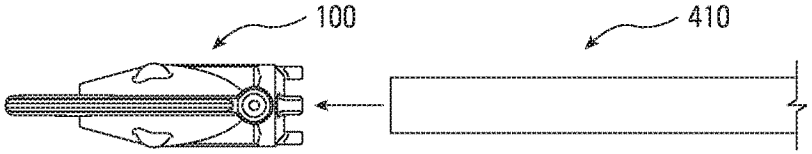

Turning now to FIGS. 7A-E a fastener installation tool 100 is illustrated connected to telescoping adapter 419 in FIG. 7A. As described above, the fastener installation tool 100 can be removed from the telescoping adapter 410 as shown in FIG. 7B. In some use situations, additional distance between the fastener installation tool 100 and the driver 490 (shown in FIG. 4A) may be desirable. Where additional distance is desirable, the fastener installation tool 100 engages a secondary extension 710 via an extension connector 720.

The fastener installation tool 100 can be part of a modular system which is connected to one or more secondary extensions 710 via one or more extension connectors 720. The modular configuration allows the tool to be used at a variety of distances away from the user. This allows the user to secure framing components at a target angle while remaining on the ground, thus eliminating the need to climb on a ladder to secure framing components or achieve a target angle of the fastener.

Figure 7C:
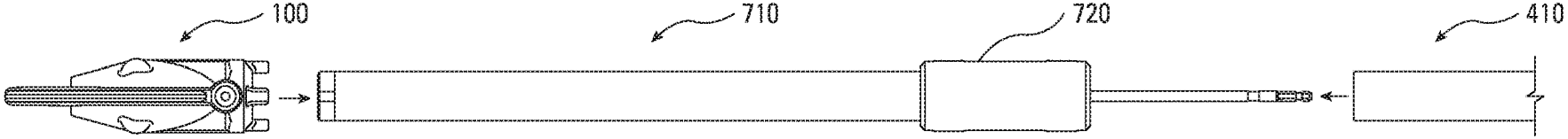
Figure 7D:
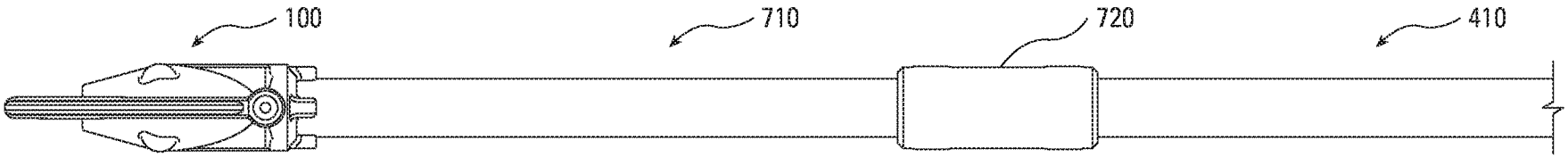
Figure 7E:
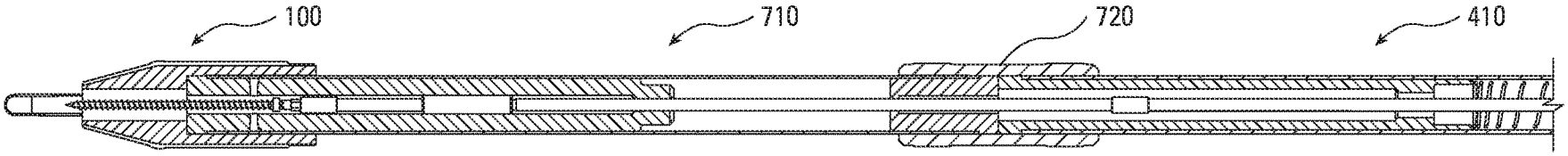

FIG. 7C illustrates the fastener installation tool 100, the secondary extension 710, the extension connector 720 and the telescoping adapter 410. When the components are connected, the fastener installation tool 100 engages the secondary extension 710 at the proximal end of the fastener installation tool 100 and the distal end of the secondary extension 710. The secondary extension 710 engages the extension connector 720 at the proximal end of the secondary extension 710 and the distal end of the extension connector 720. The extension connector 720 engages the telescoping adapter 410 at the proximal end of the extension connector 720 and the distal end of the telescoping adapter 410. FIG. 7D illustrates a side-view of the connection between the secondary extension 710, extension connector 720 and the telescoping adapter 410. A cross-section of the fastener engaging the extension and the adapter is illustrated in FIG. 7E. As illustrated, the secondary extension 710 and the telescoping adapter 410 fit within an interior of the extension connector 720.

While preferred embodiments of the present invention have been shown and described herein, it will be obvious to those skilled in the art that such embodiments are provided by way of example only. Numerous variations, changes, and substitutions will now occur to those skilled in the art without departing from the invention. It should be understood that various alternatives to the embodiments of the invention described herein may be employed in practicing the invention. It is intended that the following claims define the scope of the invention and that methods and structures within the scope of these claims and their equivalents be covered thereby.

What is claimed is:

1. A method of installing a fastener comprising:

providing a fastener installation tool having a body comprising a first member having a substantially planar profile in a first plane, a positioning member formed integrally with the first member wherein the positioning member has a rocker positioned along a length of the positioning member between a channel face of the first member and a distal end of the positioning member on a first side, an axial channel passing from the distal end of the fastener installation tool to the proximal end;

positioning the distal end of the positioning member against a target surface; and driving a fastener through the target surface.

2. The method of claim 1 further comprising the steps of providing an adapter and securing the fastener installation tool on a distal end of the adapter.

3. The method of claim 1 further comprising the steps of providing an adapter, providing a driver, engaging the adapter to the driver, and securing the fastener installation tool on a distal end of the adapter.

4. The method of claim 1 further comprising the step of providing a level tool.

5. The method of claim 4 further comprising the step of determining a level indication from the level tool.

6. The method of claim 4 further comprising the step of adjusting a position of the level tool to adjust a level indication of the level tool.

7. The method of claim 4 further comprising the step of removably securing the level indicator to an end of the fastener installation tool.

8. The method of claim 1 wherein the fastener installation tool further comprises one or more linear markers and one or more angled markers wherein at least one of the one or more linear markers is positioned on an exterior surface in the first plane and one or more angled marker are positioned on the exterior surface in the second plane and further wherein the one or more linear markers and one or more angled markers are visually distinct from a remainder of the body of the fastener installation tool.

9. The method of claim 8 further comprising the step of aligning at least one of the one or more linear marker and one or more angled markers with a surface plane of a target surface.

* * * * *